United States Patent [19]

Seelbach et al.

[11] 4,211,460

[45] Jul. 8, 1980

[54] ADAPTER FOR CONNECTING A LOAD TO A BUS BAR

[75] Inventors: Heinz Seelbach, Kierspe; Gerhard Eversberg, Lüdenscheid, both of Fed. Rep. of Germany

[73] Assignee: Erco Leuchten GmbH, Lüdenscheid, Fed. Rep. of Germany

[21] Appl. No.: 15,648

[22] Filed: Feb. 27, 1979

[30] Foreign Application Priority Data

Mar. 11, 1978 [DE] Fed. Rep. of Germany ..... 2810681

[51] Int. Cl.[2] ..... H01R 13/54

[52] U.S. Cl. ..... 339/75 M; 339/22 B

[58] Field of Search ..... 339/21 R, 22 R, 22 B, 339/75 R, 75 M, 78, 88 R, 91 R

[56] References Cited

U.S. PATENT DOCUMENTS

| | | | |
|---|---|---|---|
| 3,757,273 | 9/1973 | Hesse | 339/21 R |
| 3,760,133 | 9/1973 | Howard | 339/21 R X |
| 3,973,818 | 8/1976 | Soquenne | 339/22 B |

FOREIGN PATENT DOCUMENTS

| | | | |
|---|---|---|---|
| 2411976 | 2/1976 | Fed. Rep. of Germany | 339/22 R |

*Primary Examiner*—Roy Lake
*Assistant Examiner*—Eugene F. Desmond
*Attorney, Agent, or Firm*—Montague & Ross

[57] ABSTRACT

A bus bar with three phase conductors and one neutral conductor is engageable by an adapter in the shape of an elongate plug designed to connect an external circuit across the neutral conductor and a selected phase conductor. The adapter housing contains two parallel shafts A, B each carrying a resilient contact blade, these blades being retracted into the housing in a disengagement position and being extendible by rotation of the respective shaft through 90°. A locking slide between the two shafts prevents rotation of shaft B until shaft A has been rotated to engage its blade with the neutral conductor whereupon shaft B may be rotated, in one of two axial positions, to bring the other blade into contact with the selected phase conductor whereby shaft A is locked in its engagement position. Shaft A also carries tongue-shaped detents which in its engagement position enter grooves in the bus bar to prevent untimely withdrawal of the adapter.

10 Claims, 14 Drawing Figures

ADAPTER FOR CONNECTING A LOAD TO A BUS BAR

FIELD OF THE INVENTION

Our present invention relates to an adapter designed to connect a two-wire load circuit across two supply conductors of a bus bar having a longitudinal channel into which the adapter can be inserted.

BACKGROUND OF THE INVENTION

Adapters of this type are used, for example, to draw single-phase current from a bus bar having a neutral conductor in addition to three phase conductors. A selector switch may be used for completing the circuit to any one of these phase conductors, e.g. as described in German published specification 2,411,976. This prior-art device comprises two coaxially intercalated control shafts, one of them serving to clamp the adapter to the bus bar while the other has blades engageable on the one hand with the neutral conductor and on the other hand with the selected phase conductor. The resiliency of the blades facilitates their rotation, with the corresponding shaft, into an engagement position; the two shafts interlock in such a way that closure of the circuit becomes possible only when the adapter is firmly clamped whereas its withdrawal from the bus bar is prevented until the contact blades have been returned to a disengagement position.

A drawback of devices so constructed is that the presence of the aforementioned selector switch, in series with the contact blades designed to engage the phase conductors, unavoidably introduces an additional circuit resistance giving rise to a significant voltage drop which, particularly with loads drawing large currents, not only wastes energy but results in considerable evolution of heat.

Objects of the Invention

An object of our present invention, therefore, is to provide an adapter of the general type described above which obviates the need for a separate phase selector.

It is also an object of our invention to provide an adapter of this character which, with little or no modification, can be used with a wide variety of bus bars carrying single-phase or polyphase currents.

Summary of the Invention

An adapter according to our present invention has a housing with an insertion part, receivable in the channel of a bus bar of generally U-shaped profile, into which protrude respective extremities of a first and a second shaft whose axes are parallel to each other and which respectively carry a first and a second contact blade substantially perpendicular to their axes. Each shaft has a disengagement position facilitating introduction of the insertion part into the bus-bar channel (as well as detachment of the adapter from the bus bar) and an engagement position angularly off-set from the disengagement position, preferably by 90°, the blades being withdrawn into the housing in their disengagement position and projecting therefrom for contact with a respective supply conductor of the bus bar in their engagement position. The two shafts are respectively provided with first and second operating means for individually rotating same between their disengagement and engagement positions. The first shaft also carries detent means projecting from the housing in its engagement position for coaction with retaining means of the bus bar (such as the edges of longitudinal recesses) to prevent untimely withdrawal of the insertion part of the housing from the bus-bar channel. Within the housing we further provide locking means having first and second holding formations positioned to mate with respective coupling formations on the first and second shafts for enabling rotation of the second shaft into its engagement position only when the first shaft is in its engagement position and for enabling rotation of the first shaft into its disengagement position only when the second shaft is in its disengagement position.

Pursuant to a more particular feature of our invention, the locking means comprises a member which is movable—preferably slidable—between two shafts in a common axial plane thereof and whose ends are provided with the aforementioned holding formations.

If the bus bar has more than two conductors, such as a neutral conductor and a plurality of phase conductors, the second shaft will have a corresponding number of engagement positions angulary and/or axially separated from one another. This shaft, accordingly, may be axially displaceable between several levels for selective engagement of its blade with respective phase conductors, such axial displacement being facilitated by a suitable lengthening of the coupling formation of this shaft which in its disengagement position mates with the second holding formation on the locking member. The lengthened coupling formation may be, for example, an axially extending groove of substantially trapezoidal profile coacting with a complementary projection on the locking member. In order to retract this projection from its groove when the first shaft is in its engagement position clamping the adapter to the bus bar, the locking member is advantageously biased toward that first shaft by a spring bearing upon an indexing element which penetrates or adjoins the second holding formation but does not positively coact with the corresponding coupling formation, e.g. by being so wide as to bridge the groove constituting the latter formation. This indexing element, on the other hand, yieldably interacts with a complementary formation on the second shaft when the latter is in its engagement position; if the shaft has several such positions, a corresponding number of complementary formations will be provided. The interengagement of the spring-loaded indexing element with any such complementary formation, or with the coupling formation of the second shaft, alerts the user to the fact that the shaft is in an engagement position or in its disengagement position.

BRIEF DESCRIPTION OF THE DRAWING

The above and other features of our invention will now be described in detail with reference to the accompanying drawing in which.

Figure 1:
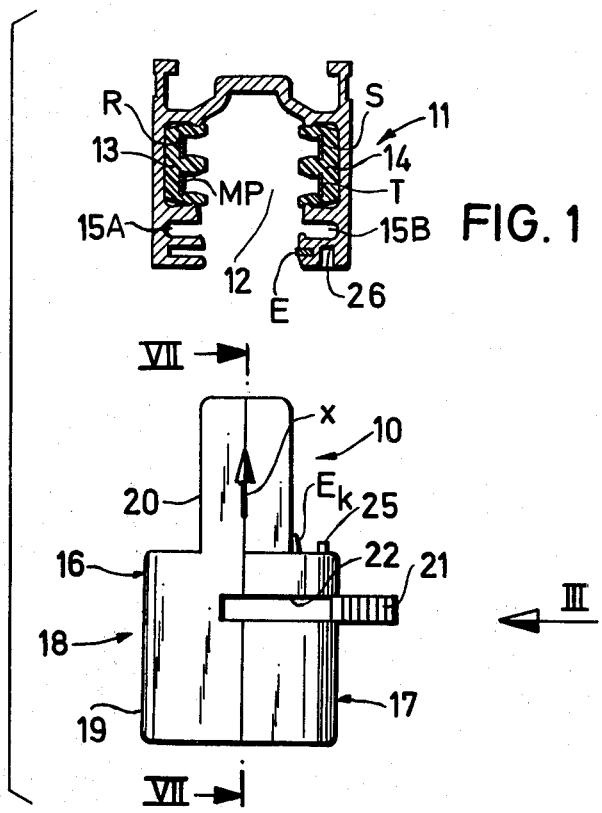
FIG. 1 is an end-elevational view of our improved adapter insertable into a bus bar shown in cross-section.
Figure 2:
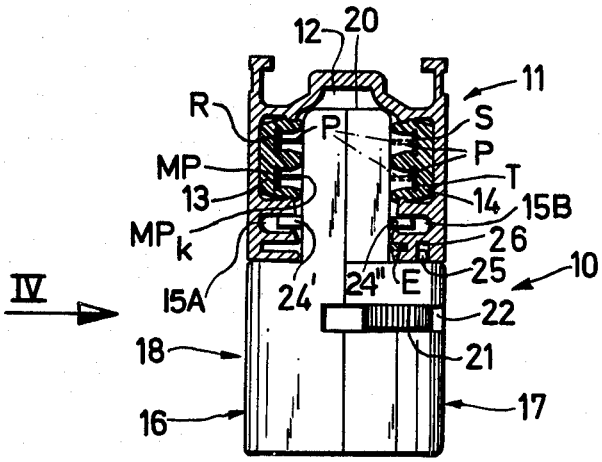
FIG. 2 is a view similar to FIG. 1, showing the adapter inserted into the bus bar.

SPECIFIC DESCRIPTION in FIGS. 1 and 2 we have shown an adapter according to our invention, generally designated 10, and an associated conventional bus bar 11. The latter has an inverted-U profile forming a channel 12 whose lateral walls are lined with dielectric strips 13, 14 serving as supports for a neutral conductor MP and three phase conductors R, S and T. A ground conductor has been shown at E. Two lateral grooves 15A and 15B are formed in the channel walls carrying conductors MP, R and S, T respectively.

Figure 3:
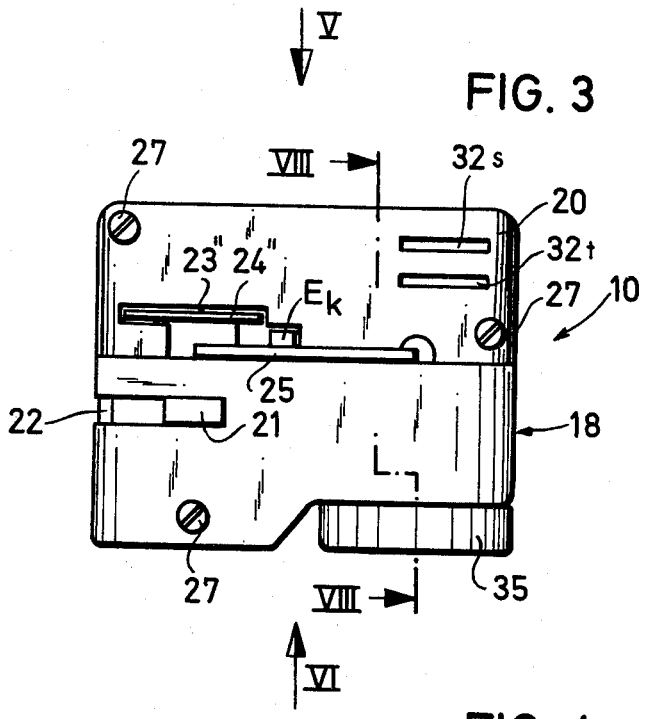
FIGS. 3 and 4 are side-elevational views of the adapter as seen in the directions of arrows III and IV, respectively, in FIG. 1.
Figure 4:
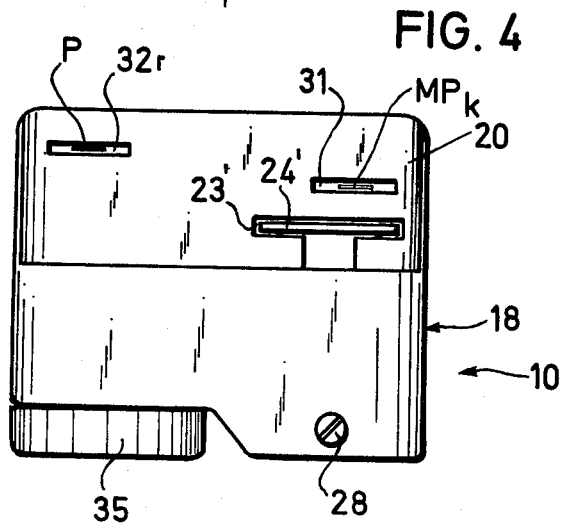
Figure 5:
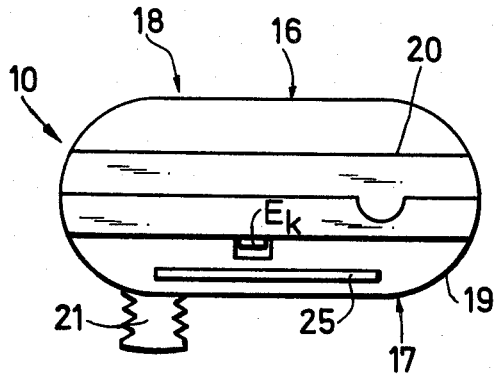
FIG. 5 is a top view of the adapter as seen in the direction of arrow V in FIG. 3.
Figure 7:
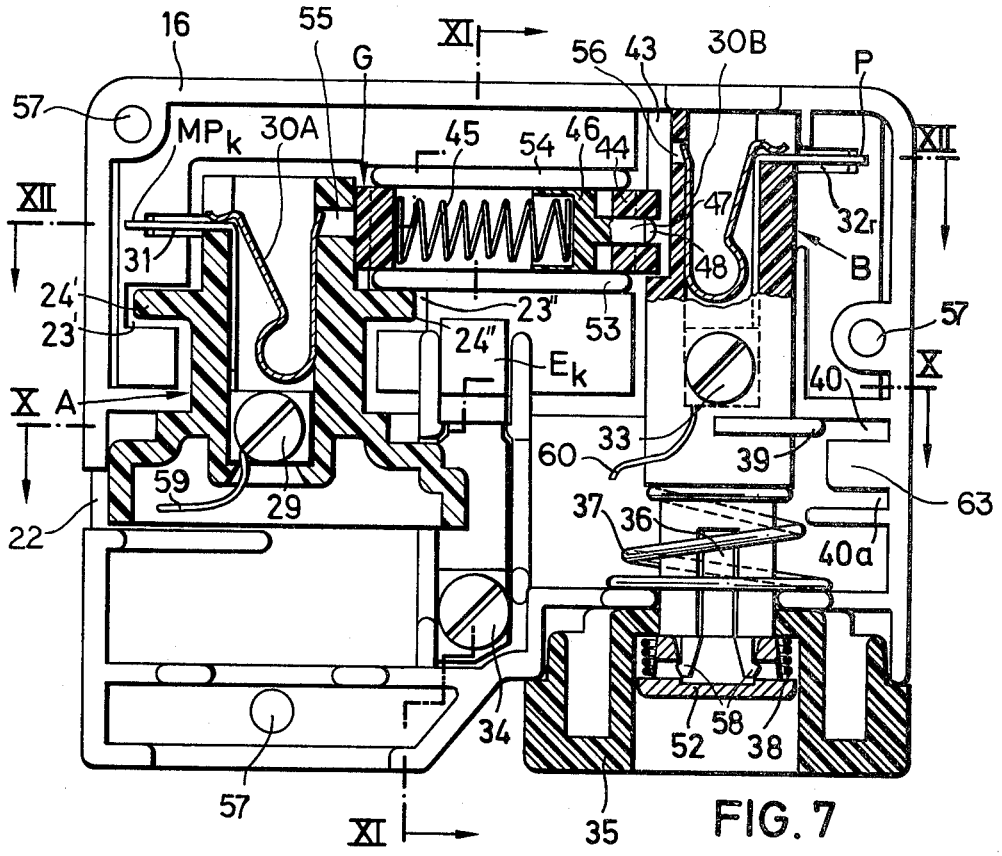
FIG. 7 is a sectional elevational view taken on the line VII—VII of FIG. 1.

The adapter 10 is in the shape of an elongate plug and has a stepped housing 18 divided into two approximately symmetrical halves 16, 17, the housing having a base portion 19 and an insertion part 20 of substantially rectangular configuration as seen in FIGS. 5 and 12–14. The two halves 16 and 17 are interconnected by throughgoing bolts 27, FIG. 3, received in apertures 57 (FIG. 7). A screw 28, shown in FIG. 4, serves for the attachment of a load such as, for example, a test lamp to the housing. The part 20 fits closely into the channel 12 of bus bar 11 upon being introduced in the direction indicated by an arrow x in FIG. 1.

In the assembled condition, illustrated in FIG. 2, two tongue-shaped detents 24', 24" project laterally from housing part 20 via respective slots 23', 23" (see FIGS. 3 and 4) to engage in grooves 15A and 15B, respectively, thereby firmly clamping the adapter to the bus bar. The outward extension of the retaining tongues 24', 24" from the interior of the housing, into which they are retracted during insertion or removal of the adapter, is carried out with the aid of a handle 21 projecting outwardly from the broader base portion 19 of the housing through a slot 22. A locator pin 25 on that base portion fits into a bore 26 of bus bar 11 to insure correct assembly. A ground lead $E_k$ protruding from the adapter housing makes contact with the ground conductor E of the bus bar.

Two contact blades $MP_k$ and P, retracted into the housing part 20 prior to assembly, are respectively engageable with neutral conductor MP and with any one of the three phase conductors R, S, T, as illustrated by solid and phantom lines in FIG. 2. Blade $MP_k$ projects outwardly through a slot 31 (FIG. 4), located on the same side as slot 23', upon actuation of handle 21 to lock the adapter in place by means of tongues 24', 24". Blade P can be selectively aligned within housing part 20 with any of three slots 32*r*, 32*s*, 32*t* respectively confronting conductors R, S and T, such alignment and the subsequent outward extension of the blade to engage the selected phase conductor being carried out with the aid of a knob 35 (see FIGS. 3, 4 and 6) as more fully described hereinafter. The resiliency of the blades $MP_k$ and P facilitates their rotary introduction into the recesses of strips 13, 14 and insures firm contact with their conductors when the adapter 10 is clamped in place.

Reference will now be made to FIGS. 7–14 for a detailed description of the internal constructon of our improved adapter.

Figure 12:
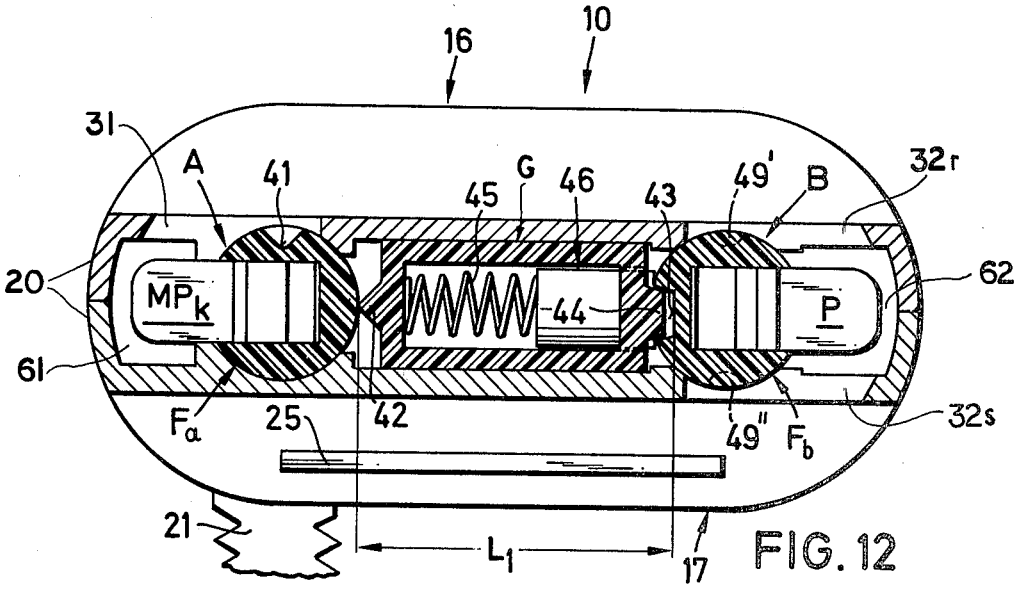
FIGS. 10, 11 and 12 are cross-sectional views taken on the lines X—X, XI—XI and XII—XII, respectively, of FIG. 7 with both control shafts of the adapter in their disengagement positions.
Figure 8:
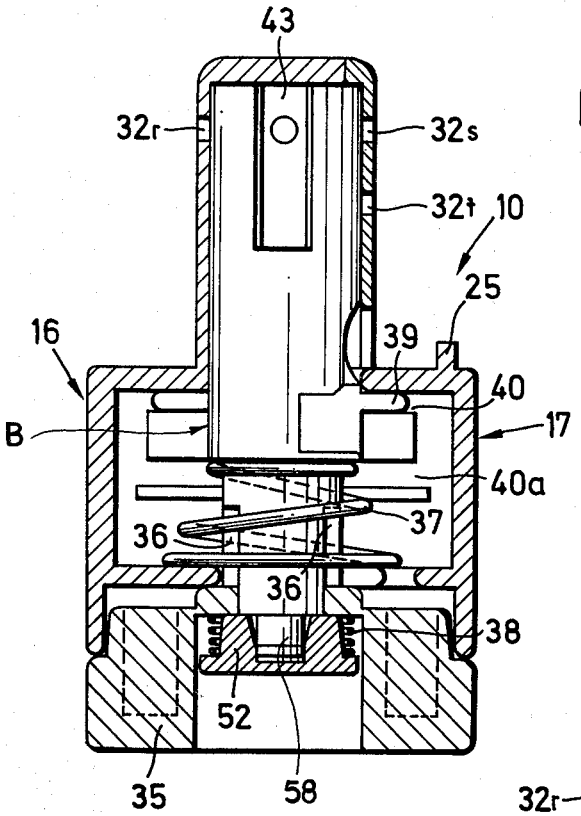
FIG. 8 is a cross-sectional view taken on the line VIII—VIII of FIG. 3, showing a control shaft of the adapter in one axial position.
Figure 9:
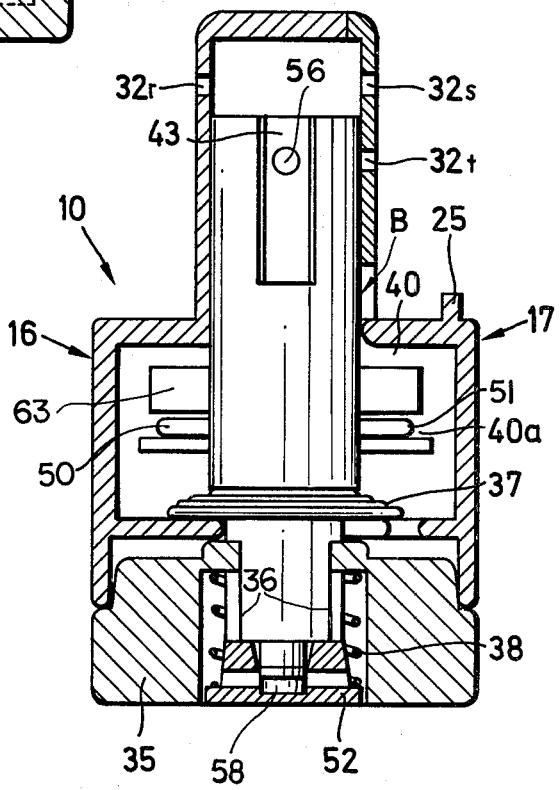
FIG. 9 is a view similar to FIG. 8 but showing the control shaft in another axial position.
Figure 10:
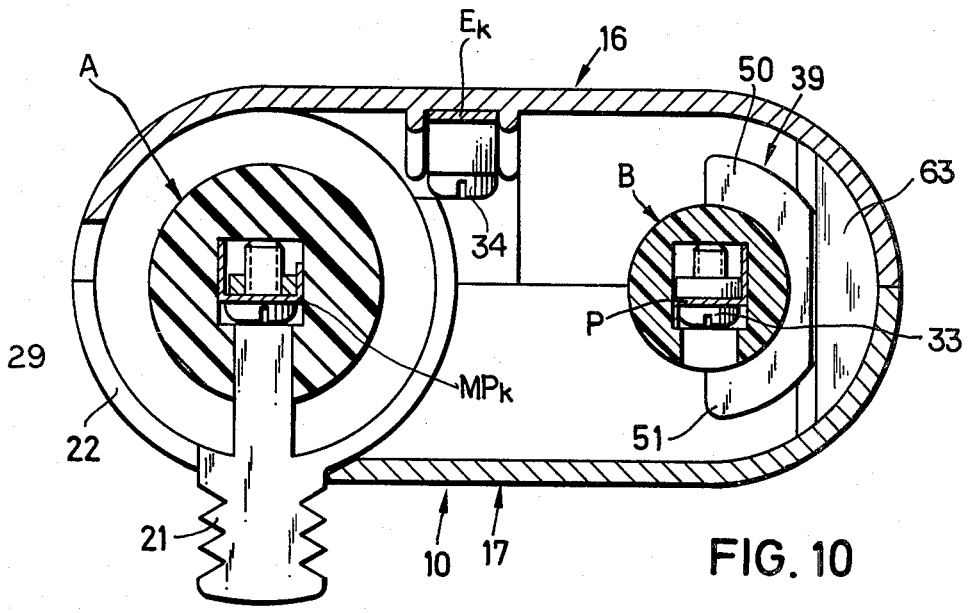

Two parallel control shafts A and B, with axes located in the longitudinal midplane of housing 18, are independently rotatable with the aid of handle 21 and knob 35, respectively. Shaft A carries the tongues 24', 24" and the blade $MP_k$ which in a disengagement position, illustrated in FIGS. 7, 10 and 12, are retracted into housing part 20, the tongue 24' and the blade $MP_k$ then occupying a pocket 61 at the left-hand end of this part. When the handle 21 is swung clockwise from the position of FIGS. 10 and 12 into its alternate position shown in FIGS. 13 and 14, the two tongues are extended outwardly through their respective slots 23', 23" (FIGS. 3 and 4) while the tip of blade $MP_k$ emerges through slot 31 for contact with the neutral conductor MP as shown in FIG. 2. Shaft A, accordingly, is rotatable through only a quarter of a turn.

Shaft B carries the blade P and, besides being rotatable through 180°, is axially shiftable between two levels for aligning that blade either with upper slots 32*r*, 32*s* or with lower slot 32*t*. In the disengagement position of shaft B illustrated in FIGS. 7, 10 and 12, blade P is received in a pocket 62 at the right-hand end of housing part 20.

The two blades $MP_k$ and P terminate at respective screws 29 and 33 which are threaded into the insulating shaft walls and grip a pair of flexible leads 59, 60 extending to the associated load such as the aforementioned test lamp. Ground lead $E_k$ is constituted by a leaf spring which is secured by another screw 34 to the conductive housing 18. Hairpin springs 30A and 30B, anchored in respective bores 55 and 56 of shafts A and B, serve to hold the free ends of blades $MP_k$ and P in line with their associated housing slots.

Shaft B is biased by a strong coil spring 37 into the elevated axial position shown in FIG. 7 in which blade P lies at the level of slots 32*r*, 32*s*. Knob 35 is secured to the lower extremity of shaft B with the aid of a cap 52 snapped into elastic engagement with a pair of retaining lugs 58 which are rigid with the shaft. Another coil spring 38, substantially weaker than spring 37, serves to keep the knob 35 in contact with the underside of the housing (as viewed in FIGS. 7–9) regardless of the axial position of shaft B which can be lowered into its alternate axial position, aligning the blade P with the slot 32*t*, by a downward pull on knob 35 against the force of spring 37. Axially extending lateral grooves 36 at the lower extremity of shaft B are engaged by internal projections of the knob so as to couple same with the shaft for joint rotation.

Two segment-shaped recesses 40 and 40*a* are separated by a shoulder 63 which is cleared by a rib 39 on shaft B (see FIG. 10) when the latter is in its disengagement position midway of its 180° range of rotation. In the upper operating position of shaft B, rib 39 is aligned with recess 40 so that a 90° swing in a clockwise or counterclockwise direction, serving to extend blade P through slots 32*s*, or 32*r*, introduces a respective wing 50 or 51 into that recess for preventing any axial shift of the shaft. In its lower operating position, a clockwise swing serving to extend the blade P through slot 32*t* brings the wing 50 into engagement with recess 40*a* for the same purpose. Counterclockwise rotation of the lowered shaft B from its disengagement position may be prevented by a nonillustrated stop coacting with rib 39.

Figure 11:
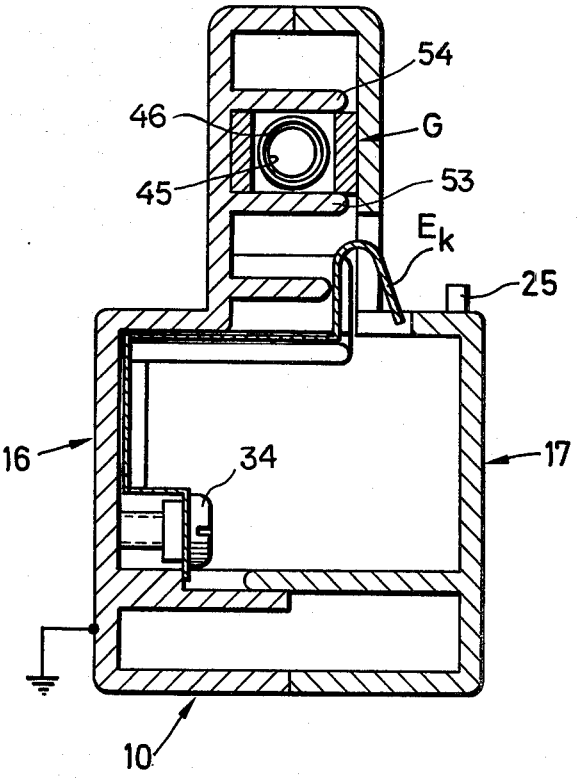
Figure 13:
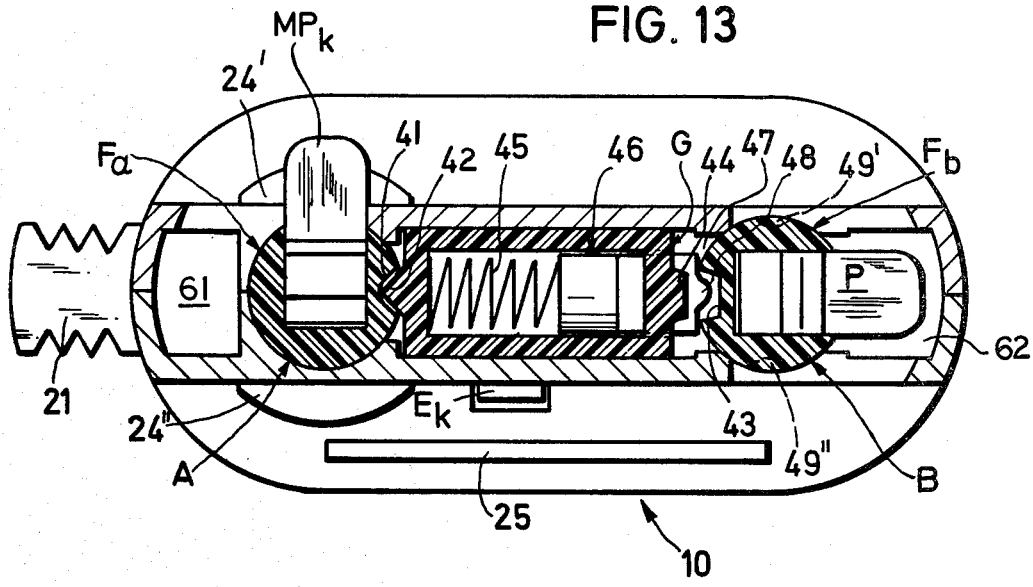
FIG. 13 is a view similar to FIG. 12 but showing one shaft in its engagement position.
Figure 14:
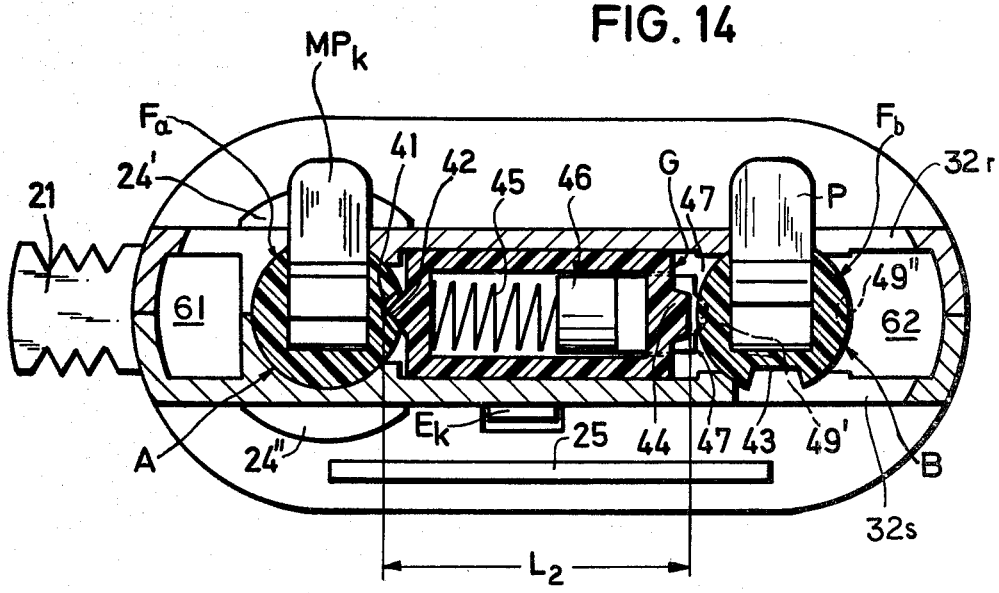
FIG. 14 is a view similar to FIG. 12, showing both shafts in their engagement positions.

According to an important feature of our invention, a locking member G is slidably inserted in housing part 20 to hold the shaft B in its disengagement position as long as shaft A occupies a corresponding position as seen in FIG. 12. Shafts A and B are provided for this purpose with coupling formations 41 and 43 in the form of peripheral notches which mate with respective holding formations 42 and 44 in the form of projections at opposite ends of member G. This member is a hollow prismatic slider guided between internal ledges 53, 54 of housing portion 16 as best seen in FIG. 11. Projection 42 has converging flanks, which are here straight but could also be somewhat curved, allowing it to be cammed out of notch 41 against the force of a biasing spring 45 when the shaft A is returned from its engagement position (FIGS. 13 and 14) into its disengagement position (FIG. 12) by a counterclockwise swing of handle 21. Spring 45, received within slider G, bears upon the periphery $F_b$ of shaft B through the intermediary of a telescopic insert 46 having a reduced extremity in the form of a web 47 which, at best seen in FIG. 7, passes midway through the projection 44 of member G into contact with shaft B. The width of this tongue, as seen in FIGS. 12–14, exceeds that of notch 43 so that only a shallow bump 48 of that web enters the notch 43 in the disengagement position of FIGS. 7, 12 and 13. The same bump 48 also engages in complementary formations 49' and 49", in the shape of shallow depressions, which are angularly offset by 90° from the notch 43 on opposite sides thereof so as to confront the bump 48 when the shaft B is in the engagement position of FIG. 14 or in its alternate engagement position in which the blade P points in the opposite direction. As seen in FIG. 7, notch 43 is an axially extending groove of sufficient length to coact with projection 44 over the full range of axial displacement of that shaft between the two levels defined by recesses 40 and 40*a*. Depression 49", coacting with bump 48 when blade P is extended through either of its two aligned slots 32*s* and 32*t*, is of similar axial length. The indexing engagement between bump 48 and notch 43 or either depression 49', 49" results in a clicking noise which apprises the user of the fact that shaft B has been rotated through its disengagement position or into one of its two engagement positions.

Figure 6:
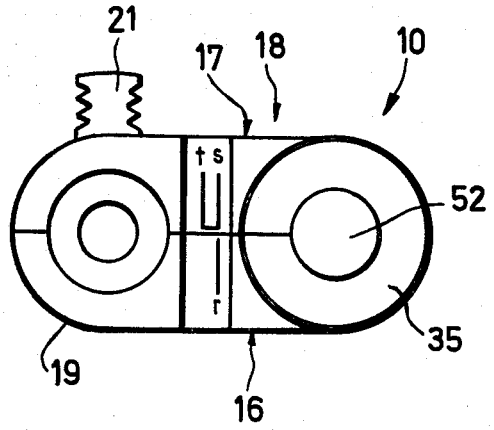
FIG. 6 is a bottom view of the adapter as seen in the direction of arrow VI in FIG. 3.

With control shafts A and B in the position of FIG. 12, facilitating insertion of adapter 10 into bus bar 11 or its withdrawal therefrom, slider G is forced to the right against the action of spring 45 by the engagement of projection 42 with the periphery $F_a$ of shaft A. Notch 43, accordingly, is positively engaged by the holding projection 44 which has substantially the same trapezoidal profile as the notch. Following assembly (FIG. 2), handle 21 is rotated into the position of FIG. 13 whereby tongues 24', 24" are extended into grooves 15A and 15B of bus bar 11 while blade $MP_k$ makes contact with neutral conductor MP, all as shown in FIG. 2. At this instant the projection 42 of slider G snaps into the notch 41 of shaft A under pressure of spring 45, thereby decoupling the slider from the shaft B which can now be rotated by means of knob 35 into the position of FIG. 14, for example, to establish contact between blade P and phase conductor R. It is, of course, also possible to turn the shaft B in the opposite direction, for contact with phase conductor S, or to do so after an axial shift of the shaft and its blade for engagement of conductor T. The several switching positions have been indicated by r, s and t on the underside of the housing, as shown in FIG. 6, in a manner similar to that used for the visualization of gear shifts in an automobile.

The distance $L_1$ between the periphery $F_a$ of shaft A and the bottom of notch 43, shown in FIG. 12, substantially equals the distance between the periphery $F_b$ of shaft B and the bottom of notch 41, being slightly greater than the length $L_2$ of slider G as measured between the tips of its projections 42 and 44. This provides a certain tolerance which, of course, will have to be less than the depth of either notch.

It will be apparent that our improved adapter could also be used, with minor modifications, on bus bars having more or less than the four conductors MP, R, S, T shown in FIGS. 1 and 2. It will also be understood that detents such as tongues 24', 24" could be additionally provided on shaft B.

We claim:

1. An adapter for connecting a two-wire load circuit across two supply conductors accessible through a longitudinal channel of a bus bar of generally U-shaped profile, comprising:

a housing with an insertion part receivable in said channel;

a first and a second shaft juxtaposed in said housing having parallel axes and extremities in said insertion part respectively provided with first and second contact blades substantially perpendicular to said axes, each of said shafts having a disengagement position facilitating introduction of said insertion part into said channel and an engagement position angularly offset from said disengagement position, said blades being withdrawn into said housing in said disengagement position and projecting therefrom for contact with a respective supply conductor in said engagement position;

first and second operating means respectively connected with said first and second shafts for individually rotating same between said disengagement and engagement positions thereof;

detent means on said first shaft projecting from said housing in said engagement position thereof for coaction with retaining elements of said bus bar to prevent untimely withdrawal of said insertion part from said channel; and locking means in said housing having first and second holding formations positioned to mate with respective coupling formations on said first and second shafts for enabling rotation of said second shaft into its engagement position only in the engagement position of said first shaft and enabling rotation of said first shaft into its disengagement position only in the disengagement position of said second shaft.

2. An adapter as defined in claim 1 wherein said locking means comprises a member movable between said shafts in a common axial plane thereof, said first and second holding formations being disposed at opposite ends of said member

3. An adapter as defined in claim 2 wherein said member is provided with biasing means urging same toward said first shaft for yieldably interfitting said first holding formations with the associated coupling formation upon arrival of said first shaft in the engagement position thereof, said first holding formation being cammable by said associated coupling formation out of engagement therewith upon return of said first shaft to the disengagement position thereof.

4. An adapter as defined in claim 3 wherein said biasing means comprises a spring, said member being provided with an indexing element adjacent said second holding formation urged by said spring into contact with said second shaft for yieldable interaction with a complementary formation on said second shaft in the engagement position of the latter.

5. An adapter as defined in claim 1, 2, 3 or 4 wherein said second shaft is axially displaceable between a plurality of levels for selectively aligning said second blade with a plurality of supply conductors to be contacted by said second blade in said engagement position thereof, the coupling formation of said second shaft being long enough to allow a shift between said levels in said disengagement position thereof.

6. An adapter as defined in claim 5 wherein said second shaft is rotatable into a plurality of alternate engagement positions on at least one of said levels.

7. An adapter as defined in claim 6 wherein said second shaft is provided with spring means axially urging same toward one of said levels, said second operating means comprising a knob secured to said second shaft.

8. An adapter as defined in claim 5 wherein said second holding formation and the coupling formation of said second shaft are respectively a projection and a slot with substantially trapezoidal cross-sections.

9. An adapter as defined in claims 2, 3 or 4 wherein said insertion part is of generally rectangular outline with a major dimension in said common axial plane and forms pockets beyond said shafts receiving said blades in the disengagement positions of the respective shafts, said pockets having lateral slots facilitating the outward extension of said blades in their engagement positions.

10. An adapter as defined in claim 9 wherein the engagement positions of said shafts are offset by 90° from their disengagement positions.

* * * * *